US009304485B1

(12) United States Patent
Holmes et al.

(10) Patent No.: US 9,304,485 B1
(45) Date of Patent: Apr. 5, 2016

(54) DEVICES AND METHODS FOR REMANUFACTURING PRINTER CARTRIDGES

(71) Applicant: Mitsubishi Kagaku Imaging Corporation, San Fernando, CA (US)

(72) Inventors: Denny Holmes, Los Angeles, CA (US); Tigran Ohanyan, Van Nuys, CA (US)

(73) Assignee: Mitsubishi Kagaku Imaging Corporation, Glendale, CA (US)

( * ) Notice: Subject to any disclaimer, the term of this patent is extended or adjusted under 35 U.S.C. 154(b) by 210 days.

(21) Appl. No.: 13/815,875

(22) Filed: Mar. 16, 2013

(51) Int. Cl.
*G03G 15/08* (2006.01)
*G03G 21/16* (2006.01)

(52) U.S. Cl.
CPC ..... *G03G 21/1676* (2013.01); *G03G 15/0812* (2013.01); *G03G 2215/00987* (2013.01)

(58) Field of Classification Search
CPC ..... G03G 15/0812; G03G 15/0894; G03G 21/181; G03G 2215/00987
USPC ..... 399/109, 119, 174; 264/36.1
See application file for complete search history.

(56) References Cited

U.S. PATENT DOCUMENTS

2008/0181657 A1* 7/2008 Ohanyan et al. ..... 399/109

FOREIGN PATENT DOCUMENTS

JP 2011212965 A * 10/2011

OTHER PUBLICATIONS

Oya (JP 2011-212965 A), Oct. 2011, JPO Computer Translation.*

* cited by examiner

*Primary Examiner* — Erika J Villaluna

(57) ABSTRACT

There is provided in one embodiment a doctor blade alignment device for aligning a doctor blade in a toner hopper of a printer cartridge. The device has an alignment assembly portion with a doctor blade contact portion having at least two magnet elements and at least two blade adjustment elements. The device further has an adjustable setting blade attached to the alignment assembly portion and substantially coextensive in length with the alignment assembly portion. The device further has a base portion attached to the adjustable setting blade and substantially coextensive in length with the adjustable setting blade. The alignment assembly portion and the adjustable setting blade calibrate the doctor blade alignment device to obtain a doctor blade alignment setting for aligning a doctor blade in a toner hopper of a printer cartridge.

17 Claims, 11 Drawing Sheets

DEVICES AND METHODS FOR REMANUFACTURING PRINTER CARTRIDGES

BACKGROUND a. Field of the Invention

The disclosure relates to electrophotography, and in particular, devices and methods for manufacturing or remanufacturing toner printer cartridges b. Background Art Printer cartridges, such as toner printer cartridges, are used in various electrophotographic imaging devices, such as laser printers, copiers, facsimile machines, and multifunction imaging devices. Once original equipment manufacturer (OEM) toner printer cartridges are used, they are often recycled and remanufactured. The process of remanufacturing a toner printer cartridge may include cleaning the cartridge, repairing damaged parts, replacing worn parts, reassembling with new parts, and replenishing the cartridge with toner. The process of remanufacturing a toner printer cartridge requires that the toner printer cartridge be disassembled so that access to the various component parts may be achieved, and further requires that the toner printer cartridge be reassembled for subsequent use.

The component parts of toner printer cartridges typically include a toner hopper, a waste hopper, a doctor blade or doctor bar, a primary charge roller (PCR), a developer roller, and an organic photoconductive (OPC) drum. The term "doctor blade" is a commonly used term in the toner printer cartridge manufacturing and remanufacturing industries and refers to an elongated material that usually includes an elongated rod with an elongated blade attached to the elongated rod. The elongated rod is usually made of metal, and the elongated blade may be made of plastic or metal. The blade may be positioned at an angle from the rod and may be positioned proximate to the developer roller with a predetermined distance.

When the toner printer cartridge is in operation, the doctor blade is typically stationary while the developer roller rolls next to the blade. The doctor blade ensures that the right amount of toner sticks to the developer roller. However, not all toner may be absorbed by the developer roller. The toner that is not absorbed by the developer roller typically accumulates around the developer roller. Since the doctor blade and the developer roller are separated by a relatively small predetermined space, the blade controls the thickness of the toner that adheres to the developer roller by scraping off toner that is not absorbed by the developer roller. If there is an excess amount of toner on the developer roller, the doctor blade scrapes off the excess amount. The developer roller then transfers the toner to the OPC drum. The OPC drum that is coated with toner then rolls over a sheet of paper, which is usually given a negative charge by the PCR. The charge of the paper is typically less negative than the charge of the toner, and thus the paper attracts the toner. The toner may be embedded on the paper according to the print pattern.

The doctor blade and the developer roller are usually detached from the toner printer cartridge during the remanufacturing process for cleaning. After cleaning, the doctor blade and the developer roller may be reassembled together usually manually with a screw driver. An assembler or user may align or position the doctor blade above the developer roller. The assembler or user may press on one side of the doctor blade and then attach with attachment means, such as screws, the same side of the doctor blade to the toner printer cartridge. The assembler or user may then execute the same steps on the remaining side. Aligning and positioning the doctor blade during replacement and remanufacture may require that the doctor blade be aligned or positioned within a few millimeters of an acceptable alignment or position point to maximize print quality during printing. Many known OEM toner printer cartridges are designed to have a doctor blade that may have the capability of being adjustable in order to adjust the doctor blade position. Thus, it may be difficult for the remanufacturer to manually align the doctor blade to the correct position.

Known methods of assembly, manufacture, or remanufacture of toner printer cartridges may not provide a uniform distance between the doctor blade and the developer roller from one side of the doctor blade to the other. As a result, the print quality may be affected, as the toner level on the developer roller is not effectively regulated by the doctor blade. One side of the developer roller may produce darker images than the other, or vice-versa. Moreover, known methods of assembly, manufacture, or remanufacture of toner printer cartridges, such as positioning or aligning a doctor blade, may require an assembler or user to manually align and position the doctor blade and may result in misalignment or damage to the doctor blade. For example, an assembler or user may have to manually hold the doctor blade in order to tighten fasteners such as screws to secure the doctor blade to the toner hopper.

In addition, known methods of assembly or remanufacture of toner printer cartridges may require permanent attachment of two or more spacers, inserts, shims, or other spacing elements within the gap or area formed between the doctor blade and the printer cartridge body in order to maintain a desired gap or area distance. The use of such permanent spacers, inserts, shims, or other spacing elements may increase the overall cost and complexity and decrease the overall efficiency of the assembly, manufacturing, or remanufacturing processes. Moreover, such spacers, inserts, shims, or spacing elements may have to have a required thickness that may limit the type of spacer, insert, shim, or spacing element that may be used.

Accordingly, there is a need for an improved device and method for assembling, manufacturing, and remanufacturing toner printer cartridges, including aligning doctor blades, that overcomes the issues associated with known devices and methods.

SUMMARY

This need for an improved device and method for remanufacturing toner printer cartridges, including aligning doctor blades, is satisfied.

There is provided in one embodiment a doctor blade alignment device for aligning a doctor blade in a toner hopper of a printer cartridge. The doctor blade alignment device comprises an alignment assembly portion comprising a doctor blade contact portion with at least two magnet elements and at least two blade adjustment elements. The doctor blade alignment device further comprises an adjustable setting blade attached to the alignment assembly portion and substantially coextensive in length with the alignment assembly portion. The doctor blade alignment device further comprises a base portion attached to the adjustable setting blade and substantially coextensive in length with the adjustable setting blade. The alignment assembly portion and the adjustable setting blade calibrate the doctor blade alignment device to obtain a doctor blade alignment setting for aligning a doctor blade in a toner hopper of a printer cartridge.

There is provided in another embodiment a doctor blade alignment device for aligning a doctor blade in a toner hopper of a remanufactured printer cartridge. The doctor blade alignment device comprises an alignment assembly portion comprising a doctor blade contact portion with at least two magnet elements, at least two setting pin elements, and at least two blade adjustment elements. The doctor blade alignment device further comprises an adjustable setting blade attached to the alignment assembly portion and substantially coextensive in length with the alignment assembly portion. The doctor blade alignment device further comprises a base portion substantially coextensive in length with the adjustable setting blade. The alignment assembly portion and the adjustable setting blade set the doctor blade alignment device to obtain a doctor blade alignment setting for aligning a doctor blade in a toner hopper of a remanufactured printer cartridge.

There is provided in another embodiment a method for aligning a doctor blade in a toner hopper of a printer cartridge. The method comprises the step of providing a doctor blade alignment device comprising at least an alignment assembly portion and an adjustable setting blade. The method further comprises the step of calibrating the doctor blade alignment device with the alignment assembly portion and the adjustable setting blade to obtain a doctor blade alignment setting. The method further comprises the step of positioning a doctor blade in a toner hopper of a printer cartridge. The method further comprises the step of coupling the doctor blade alignment device to the doctor blade. The method further comprises the step of aligning the doctor blade in the toner hopper of the printer cartridge with the doctor blade alignment setting of the doctor blade alignment device.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for remanufacturing printer cartridges, such as toner printer cartridges, and in particular, for aligning and positioning a doctor blade in a toner hopper of a toner printer cartridge or remanufactured toner printer cartridge or for aligning and positioning a calibration doctor blade in a calibration toner hopper of a calibration toner printer cartridge. The disclosed embodiments of the devices and methods may be used with toner printer cartridges that can be used in laser printer engine models, such as, Hewlett Packard (HP) Company families of laser printer engine models, for example, HPM451, HP3525, HP4525, HP5525, or other suitable laser printer engine models.

Figure 1:
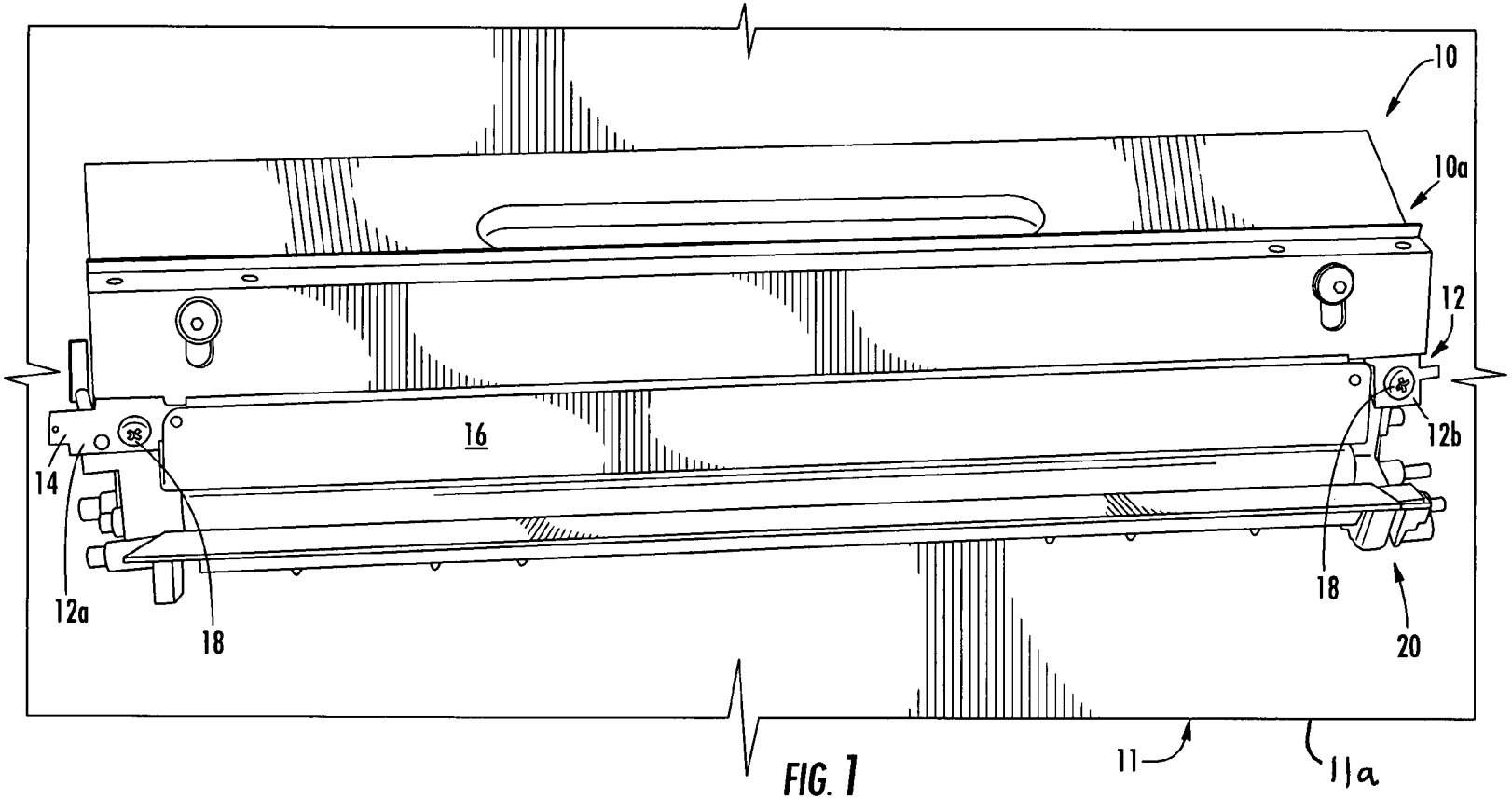
FIG. 1 shows a front perspective view of one of the embodiments of a doctor blade alignment device of the disclosure attached to a doctor blade in a toner hopper of a printer cartridge.

Embodiments of a doctor blade alignment device 10 (see FIG. 1), such as in the form of a hand-held doctor blade alignment device 10*a* (see FIG. 2*a*), and a mountable doctor blade alignment device 10*b* (see FIG. 3A), and related alignment method 200 (see FIG. 7) are provided. Referring to the Figures, FIG. 1 shows a front perspective view of one of the embodiments of a doctor blade alignment device 10, such as in the form of doctor blade alignment device 10*a*, of the disclosure attached to a doctor blade 12 in a toner hopper 20 of a printer cartridge 11, such as a remanufactured printer cartridge 11*a*. The printer cartridge 11 is preferably a toner printer cartridge for use in electrophotographic imaging devices, such as laser printers, copiers, facsimile machines, multifunction imaging devices, or another suitable electrophotographic imaging device. As shown in FIG. 1, the printer cartridge 11 includes the toner hopper 20 with the doctor blade 12 positioned in the toner hopper 20. As shown in FIG. 1, the doctor blade 12 comprises a first mounting end 12*a*, a second mounting end 12*b*, a support portion 14, and a blade portion 16 attached to the support portion 14 with fastener members 18, such as in the form of screws, bolts, or another suitable fastener member. The printer cartridge 11 may also comprise other known components such as a developer roller (not shown), end caps (not shown), organic photoconductor (not shown), and other suitable components.

Figure 2A:
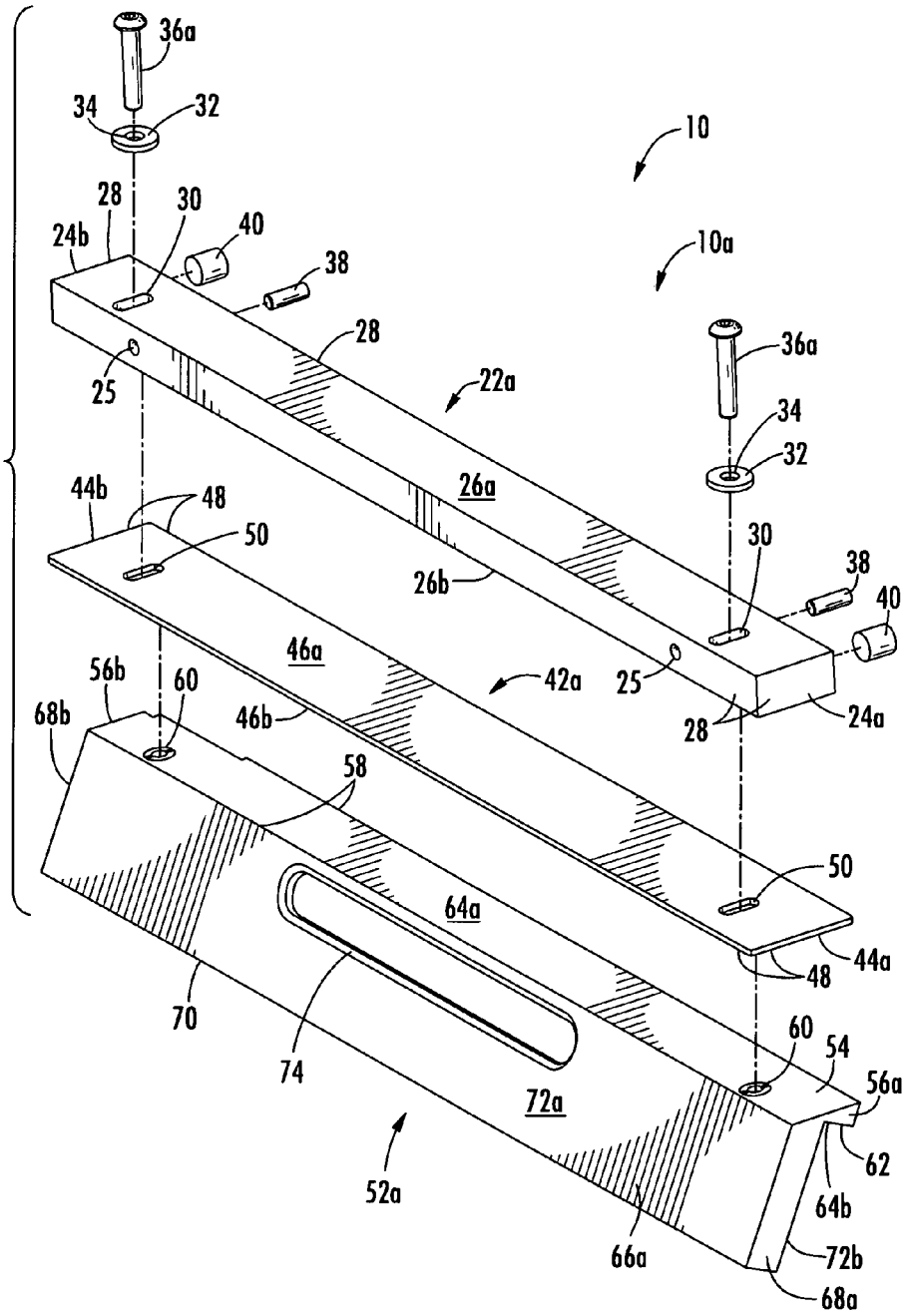
FIG. 2A shows a perspective exploded view of one of the embodiments of a doctor blade alignment device of the disclosure.
Figure 2B:
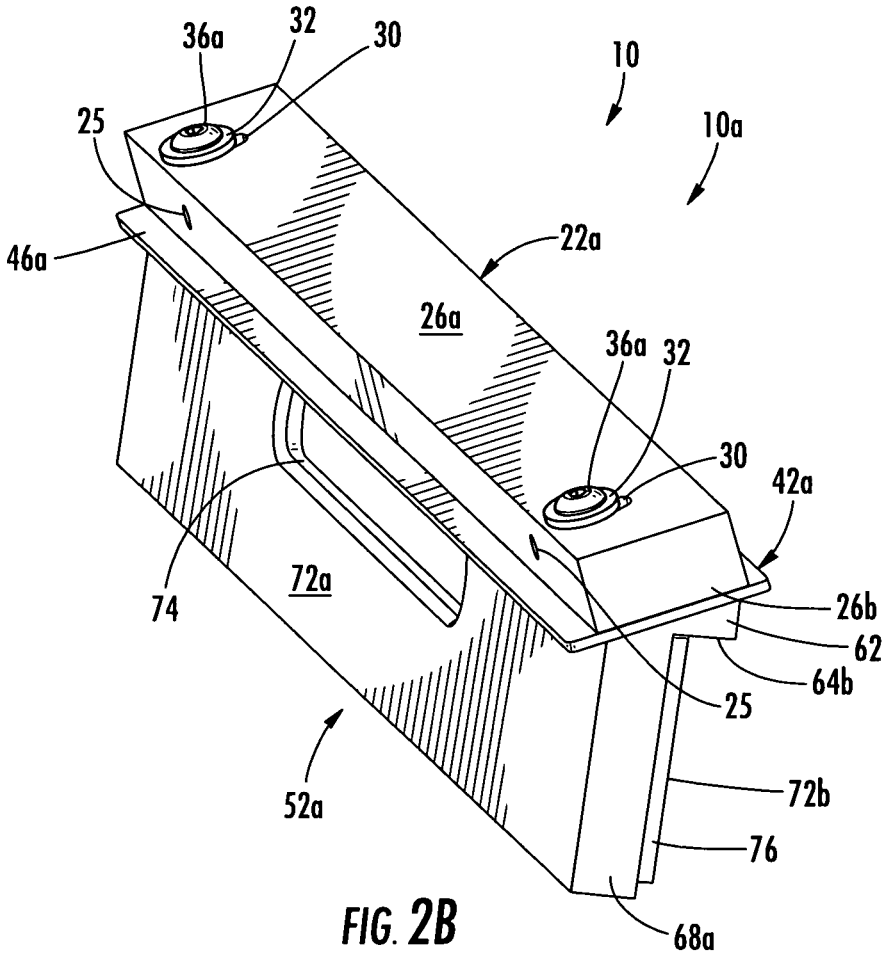
FIG. 2B shows a perspective assembled view of the doctor blade alignment device of FIG. 2A.

There is provided in one embodiment a doctor blade alignment device 10 for aligning a doctor blade 12 in a toner hopper 20 of a printer cartridge 11. FIG. 2A shows a perspective exploded view of one of the embodiments of a doctor blade alignment device 10, such as in the form of a hand-held doctor blade alignment device 10*a*, of the disclosure. FIG. 2B shows a perspective assembled view of the doctor blade alignment device 10, such as in the form of the hand-held doctor blade alignment device 10*a*, of FIG. 2A. As shown in FIGS. 2A-2B, the doctor blade alignment device 10, such as in the form of a hand-held doctor blade alignment device 10*a*, comprises an alignment assembly portion 22*a*. The alignment assembly portion 22*a* (see FIGS. 2A-2B) comprises a doctor blade contact portion 26*a* preferably in the form of an elongated rectangular bar 26*b*. As shown in FIG. 2A, the doctor blade contact portion 26*a* comprises a first end 24*a*, a second end 24*b*, a plurality of sidewalls 28, such as four sidewalls 28, and at least two openings 25 (see also FIG. 2B) along one of the sidewalls 28. As shown in FIGS. 2A-2B, the doctor blade contact portion 26*a* further comprises two slot through openings 30. The slot through openings 30 are preferably spaced apart from each other and with one slot through opening 30 formed through the surface of the doctor blade contact portion 26*a* near the first end 24*a*, and one slot through opening 30 formed through the surface of the doctor blade contact portion 26*a* near the second end 24*b*.

As shown in FIG. 2A, the alignment assembly portion 22*a* further comprises at least two magnet elements 40. The at least two magnet elements 40 are spaced apart along the doctor blade contact portion 26*a* and are configured to contact the support portion 14 (see FIG. 1) of the doctor blade 12 (see FIG. 1) during alignment of the doctor blade 12 in the toner hopper 20 (see FIG. 1).

As shown in FIGS. 2A-2B, the alignment assembly portion 22*a* further comprises at least two blade adjustment elements 36*a*, such as in the form of screws, bolts, or other suitable insertable fastener-type devices. Each blade adjustment element 36*a* (see FIGS. 2A-2B) may be inserted through a collar device 32 (see FIGS. 2A-2B), such as a washer or the like, having an insertion opening 34 (see FIG. 2A). As shown in FIGS. 2A-2B, each blade adjustment element 36*a* is preferably configured for insertion through the collar device 32 and insertion through each respective slot through opening 30 in the doctor blade contact portion 26*a*. Each slot through opening 30 is configured to receive each blade adjustment element 36*a*.

As shown in FIG. 2A, the alignment assembly portion 22*a* further comprises at least two setting pin elements 38 spaced apart along the doctor blade contact portion 26*a* and configured to contact the support portion 14 (see FIG. 1) of the doctor blade 12 (see FIG. 1) during alignment of the doctor blade 12 in the toner hopper 20 (see FIG. 1). The at least two setting pin elements 38 preferably maintain a repeatable tolerance for the doctor blade alignment setting.

Figure 5:
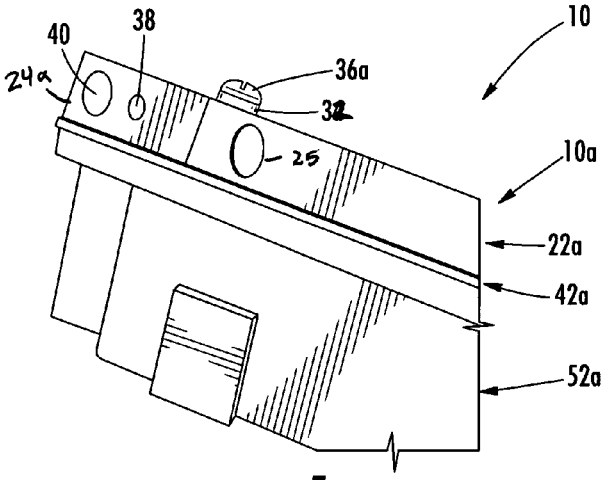
FIG. 5 is a partial front view of one of the embodiments of a doctor blade alignment device of the disclosure.
Figure 6:
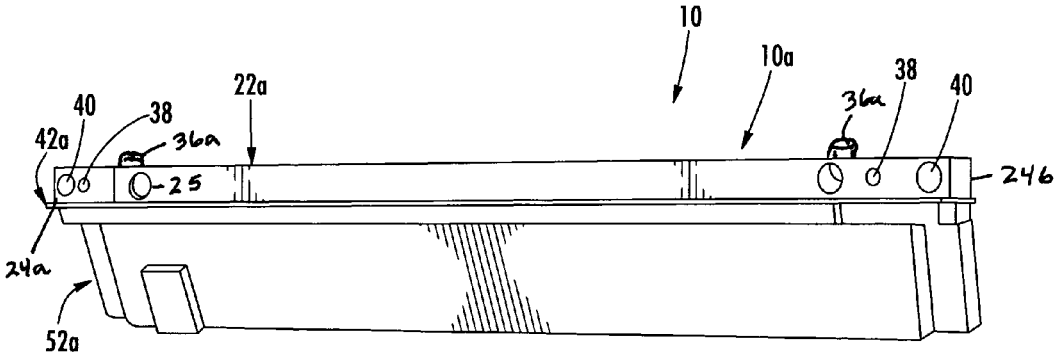
FIG. 6 is a front view of the doctor blade alignment device of FIG. 5; and, FIG. 7 is an illustration of a flow diagram of an embodiments of a method of the disclosure.

FIG. 5 is a partial front view of one of the embodiments of the doctor blade alignment device 10, such as in the form of the hand-held doctor blade alignment device 10*a*, of the disclosure. FIG. 6 is a front view of the doctor blade alignment device 10, such as in the form of the hand-held doctor blade alignment device 10*a*, of FIG. 5. As shown in FIGS. 5, 6, one magnet element 40 and one setting pin element 38 are shown inserted in the alignment assembly portion 22*a* near the first end 24*a* (see FIG. 2A) of the alignment assembly portion 22*a*, and another magnet element 40 and another setting pin element 38 are shown inserted in the alignment assembly portion 22*a* near the second end 24*b* (see FIG. 2A) of the alignment assembly portion 22*a*, with only the end faces of each magnet element 40 and each setting pin element 38 exposed. FIGS. 5, 6 further show the blade adjustment elements 36*a* inserted through the alignment assembly portion 22*a*. FIGS. 5, 6 further show an adjustable setting blade 42*a* and a base portion 52*a*, both discussed in detail below.

As shown in FIGS. 2A-2B, the doctor blade alignment device 10, such as in the form of a hand-held doctor blade alignment device 10*a*, further comprises an adjustable setting blade 42*a* that is preferably attached to the alignment assembly portion 22*a* and is substantially coextensive in length with the alignment assembly portion 22*a*. As shown in FIGS. 2A-2B, the adjustable setting blade 42*a* preferably comprises an elongated rectangular blade 46*a* comprised of a metal material, such as stainless steel, steel, or another suitable metal material. As shown in FIG. 2A, the adjustable setting blade 42*a* further comprises a first end 44*a*, a second end 44*b*, and a plurality of straight edges 48, such as four straight edges 48. As shown in FIG. 2A, the adjustable setting blade 42*a* further comprises two slot through openings 50. The slot through openings 50 are preferably spaced apart from each other and with one slot through opening 50 formed through the surface of the adjustable setting blade 42*a* near the first end 44*a*, and one slot through opening 50 formed through the surface of the adjustable setting blade 42*a* near the second end 44*b*.

As shown in FIGS. 2A-2B, the doctor blade alignment device 10, such as in the form of a hand-held doctor blade alignment device 10*a*, further comprises a base portion 52*a* that is preferably attached to the adjustable setting blade 42*a* and is substantially coextensive in length with the adjustable setting blade 42*a* as well as substantially coextensive in length with the alignment assembly portion 22*a*. The alignment assembly portion 22*a* and the base portion 52*a* are preferably both constructed of a sturdy material, such as plastics; thermoplastics such as polyvinyl chloride (PVC), polyethylene (PE), polypropylene (PP), or another suitable thermoplastic; acrylic; metals; or other suitable sturdy materials.

As shown in FIG. 2A, the base portion 52*a* comprises a first portion 54 and a second portion 70. As shown in FIGS. 2A-2B, in this embodiment of the doctor blade alignment device 10, such as in the form of the hand-held doctor blade alignment device 10*a*, the first portion 54 and the second portion 70 of the base portion 52*a* may preferably form a substantially L-shaped configuration 64*b*.

As shown in FIG. 2A, the first portion 54 preferably comprises an elongated rectangular mounting portion 64*a* having a first end 56*a*, a second end 56*b*, and a plurality of edges 58, such as four edges 58. As further shown in FIG. 2A, the first portion 54 may comprise at least two insert openings 60. The insert openings 60 are preferably spaced apart from each other and with one insert opening 60 formed through the surface of the first portion 54 near the first end 56*a*, and one insert opening 60 formed through the surface of the first portion 54 near the second end 56*b*.

As further shown in FIG. 2A, the second portion 70 preferably comprises an elongated extending portion 66*a* having a first end 68*a*, a second end 68*b*, and an outer side 72*a* having an elongated slot opening 74. The elongated slot opening 74 is preferably configured to be gripped or held by a user or operator to grip or hold the hand-held doctor blade alignment device 10*a* when in use.

As further shown in FIGS. 2A-2B, an inner side 72*b* of the base portion 52*a* may comprise one or more support portions configured for supporting and positioning the doctor blade alignment device 10 on and to the toner hopper 20 (see FIG. 1) during alignment of the doctor blade 12 (see FIG. 1) in the toner hopper 20. The one or more support portions may comprise one or more of a first support portion 62 (see FIGS. 2A-2B and FIG. 4) on the first portion 54 (see FIG. 2A) of the base portion 52*a*, a second support portion 76 (see FIG. 2B and FIG. 4) on the second portion 70 (see FIG. 2A) of the base portion 52*a*, and a third support portion 75 (see FIG. 4) on the second portion 70 (see FIG. 2A) of the base portion 52*a* (see FIG. 4).

Figure 4:
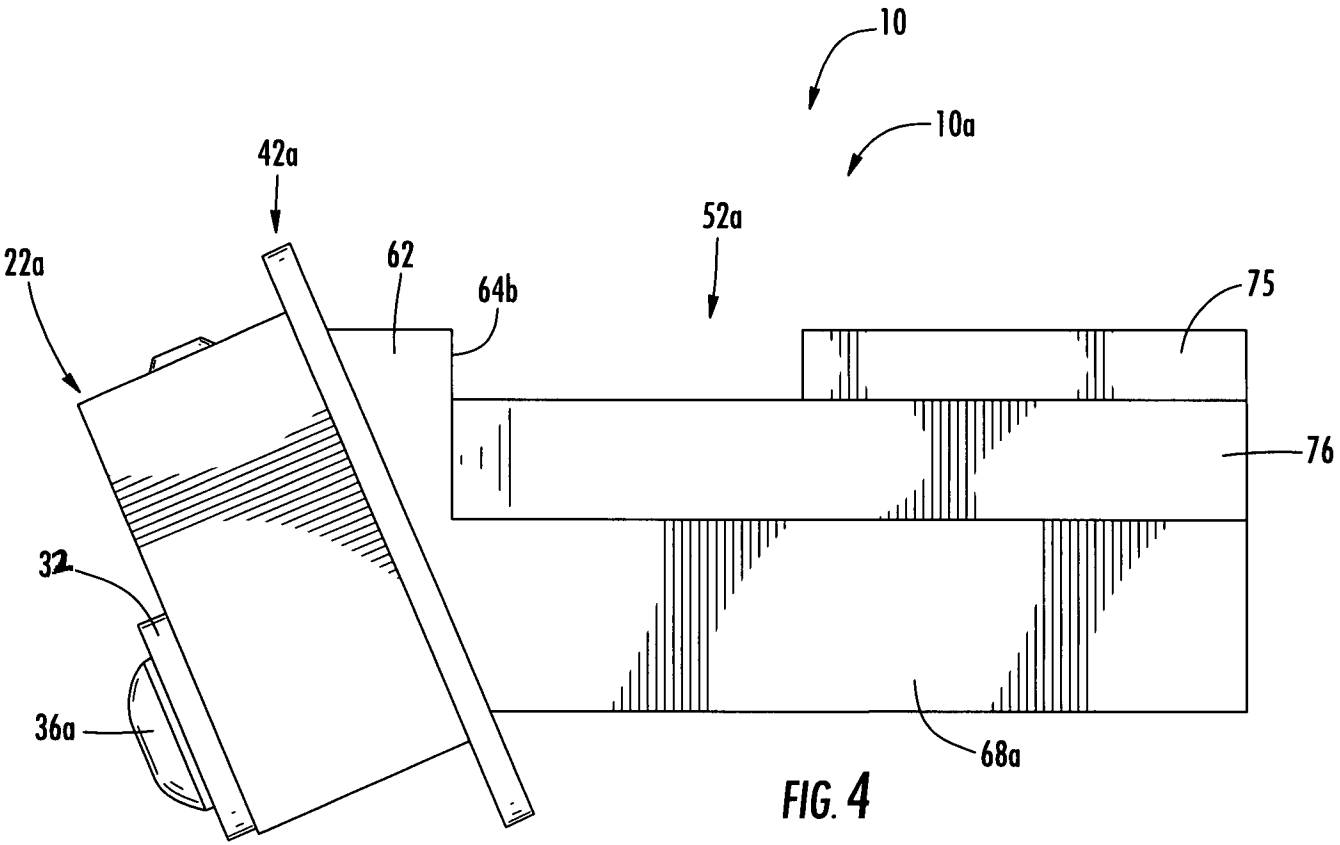
FIG. 4 is a side view of one of the embodiments of a doctor blade alignment device of the disclosure.

FIG. 4 is a side view of the doctor blade alignment device 10, such as in the form of the hand-held doctor blade alignment device 10*a*, of the disclosure. When the doctor blade alignment device 10, such as in the form of a hand-held doctor blade alignment device 10*a*, is fully assembled such as shown in FIG. 2A and FIG. 4, the blade adjustment elements 36*a* are preferably inserted through the slot through openings 30, the slot through openings 50, and the insert openings 60, to attach together the alignment assembly portion 22*a*, the adjustable setting blade 42*a*, and the base portion 52*a*. As shown in FIG. 4, the adjustable setting blade 42*a* is attached between the alignment assembly portion 22*a* and the base portion 52*a*. As further shown in FIG. 4, the first support portion 62 of the base portion 52*a*, the second support portion 76 of the base portion 52*a*, and the third support portion 75 of the base portion 52*a* may be formed in various shapes and such shapes may vary depending on the configuration of the toner hopper 20 and printer cartridge 11 used in the alignment of the doctor blade 12 (see FIG. 1).

The alignment assembly portion 22*a* (see FIG. 2A) and the adjustable setting blade 42*a* (see FIG. 2A) calibrate the doctor blade alignment device 10 (FIG. 2A) to obtain a doctor blade alignment setting for aligning a doctor blade 12 (see FIG. 1) in a toner hopper 20 (see FIG. 1) of a printer cartridge 11 (see FIG. 1), such as a remanufactured printer cartridge 11*a* (see FIG. 1).

Figure 3A:
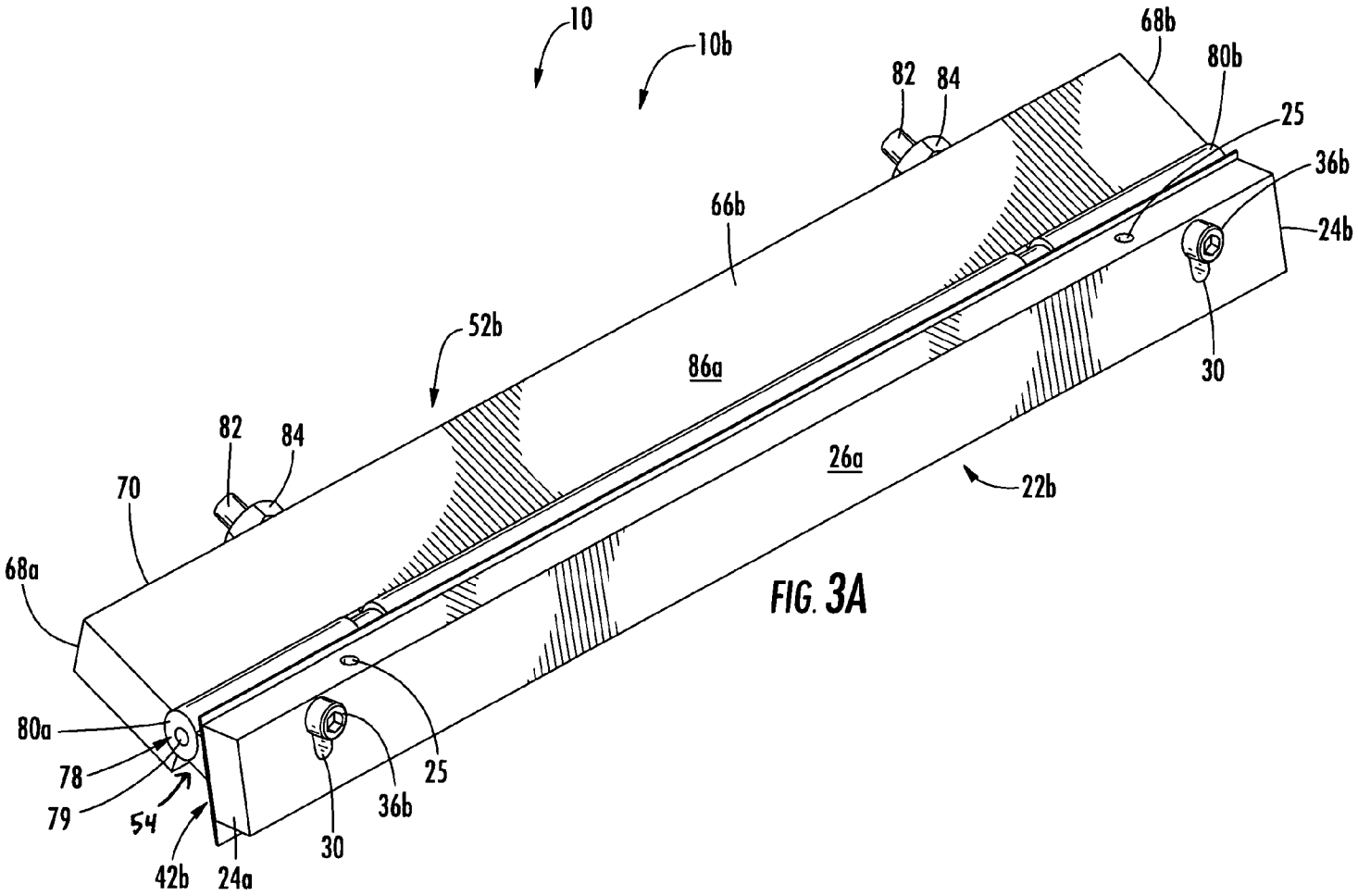
FIG. 3A is a back perspective view of another one of the embodiments of a doctor blade alignment device of the disclosure.
Figure 3B:
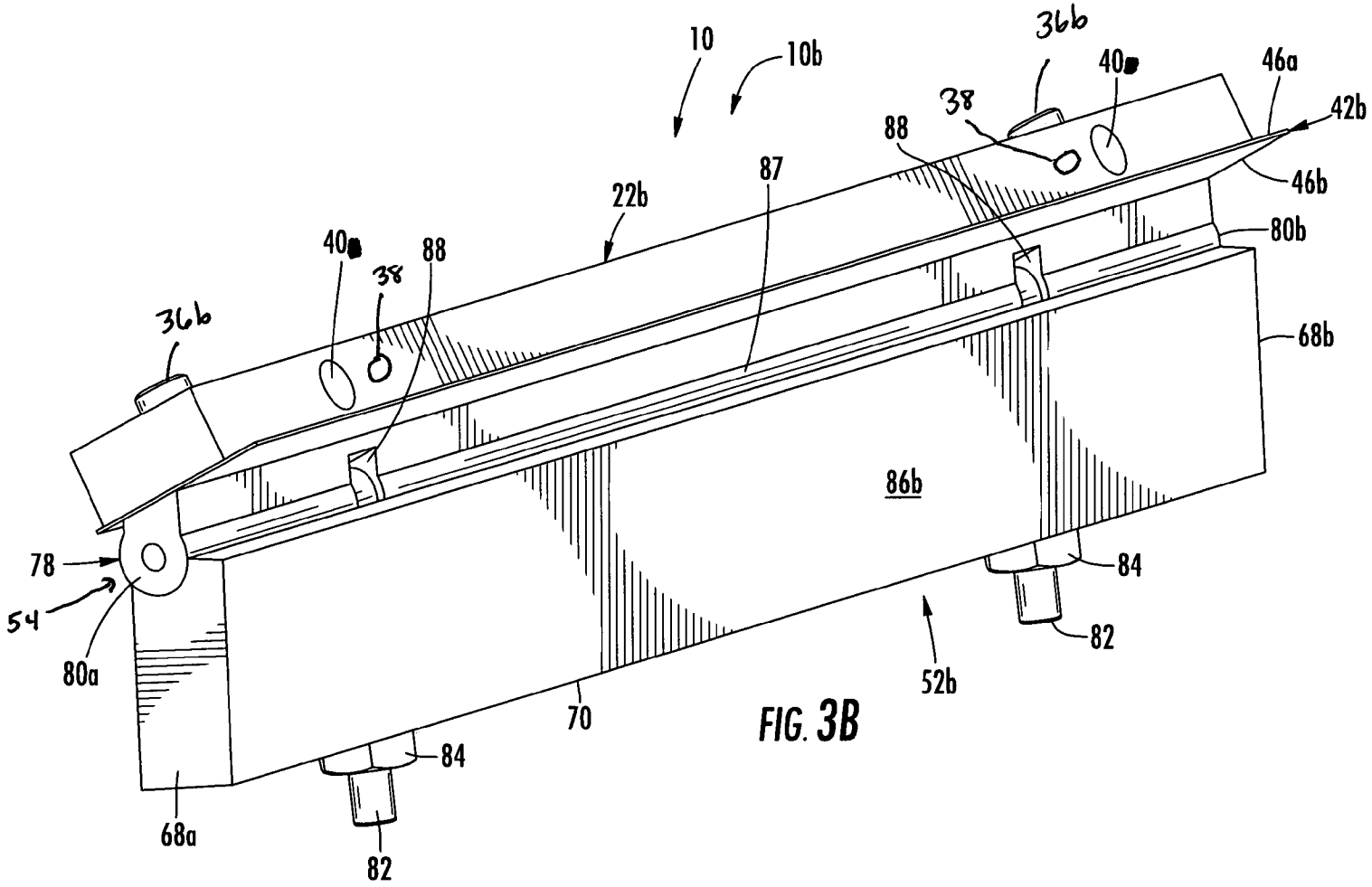
FIG. 3B is a front perspective view of the doctor blade alignment device of FIG. 3A.

FIGS. 3A-3E show another embodiment of the doctor blade alignment device 10, such as in the form of a mountable doctor blade alignment device 10*b*, for mounting to a toner hopper 20 (see FIG. 3C) of a printer cartridge 11 (see FIG. 1). FIG. 3A is a back perspective view of another one of the embodiments of the doctor blade alignment device 10, such as in the form of a mountable doctor blade alignment device 10*b*, of the disclosure. FIG. 3B is a front perspective view of the doctor blade alignment device 10, such as in the form of a mountable doctor blade alignment device 10*b*, of FIG. 3A.

As shown in FIGS. 3A-3B, the doctor blade alignment device 10, such as in the form of the mountable doctor blade alignment device 10*b*, comprises an alignment assembly portion 22*b*. The alignment assembly portion 22*b* (see FIG. 3A) comprises a doctor blade contact portion 26*a* preferably in the form of an elongated rectangular bar 26*b*. As shown in FIG. 3A, the alignment assembly portion 22*b* comprises a first end 24*a*, a second end 24*b* and at least two openings 25 along a sidewall 28 (see FIG. 2A). As shown in FIGS. 3A-3B, alignment assembly portion 22*b* further comprises two slot through openings 30. The slot through openings 30 are preferably spaced apart from each other and with one slot through opening 30 formed through the surface of the alignment assembly portion 22*b* near the first end 24*a*, and the other slot through opening 30 formed through the surface of the alignment assembly portion 22*b* near the second end 24*b*.

As shown in FIG. 3B, the alignment assembly portion 22*b* further comprises at least two magnet elements 40. The at least two magnet elements 40 are spaced apart along the alignment assembly portion 22*b* and are configured to contact the support portion 14 (see FIG. 3E) of the doctor blade 12 (see FIG. 3E) during alignment of the doctor blade 12 in the toner hopper 20 (see FIG. 3E).

As shown in FIGS. 3A-3B, the alignment assembly portion 22*b* further comprises at least two blade adjustment elements 36*b*, such as in the form of screws, bolts, or other suitable insertable fastener-type devices. Each blade adjustment element 36*b* (see FIGS. 3A-3B) is preferably configured for insertion through each respective slot through opening 30 (see FIG. 3A) in the alignment assembly portion 22*b*. Each slot through opening 30 is configured to receive each blade adjustment element 36*b*. In this embodiment, the blade adjustment elements 36*b* are not used with the collar device 32 (see FIG. 2A) but other embodiments may use the blade adjustment element 36*a* (see FIG. 2A) with the collar device 32.

As shown in FIG. 3B, the alignment assembly portion 22*b* further comprises at least two setting pin elements 38 spaced apart along the alignment assembly portion 22*b* and configured to contact the support portion 14 (see FIG. 1) of the doctor blade 12 (see FIG. 1) during alignment of the doctor blade 12 in the toner hopper 20 (see FIG. 1).

As shown in FIGS. 3A-3B, the doctor blade alignment device 10, such as in the form of the mountable doctor blade alignment device 10*b*, further comprises an adjustable setting blade 42*b* that is preferably attached to the alignment assembly portion 22*b* and is substantially coextensive in length with the alignment assembly portion 22*b*. As shown in FIGS. 3A-3B, the adjustable setting blade 42*b* preferably comprises an elongated rectangular blade 46*a* comprised of a metal material, such as stainless steel, steel, or another suitable metal material. The adjustable setting blade 42*b* (see FIG. 3A) is similar to the adjustable setting blade 42*a* (see FIG. 2A) that comprises the first end 44*a*, the second end 44*b*, and the plurality of straight edges 48, such as four straight edges 48. The adjustable setting blade 42*b* may further similarly comprise two slot through openings 50 (see FIG. 2A) as shown with the adjustable setting blade 42*a*.

As shown in FIGS. 3A-3B, the doctor blade alignment device 10, such as in the form of the mountable doctor blade alignment device 10*b*, further comprises a base portion 52*b* that is preferably attached to the adjustable setting blade 42*b* and is substantially coextensive in length with the adjustable setting blade 42*b* as well as substantially coextensive in length with the alignment assembly portion 22*b*. The alignment assembly portion 22*b* and the base portion 52*b* are preferably both constructed of a sturdy material, such as plastics; thermoplastics such as polyvinyl chloride (PVC), polyethylene (PE), polypropylene (PP), or another suitable thermoplastic; acrylic; metals; or other suitable sturdy materials.

As shown in FIGS. 3A-3B, the base portion 52*b* comprises a first portion 54 and a second portion 70. In this embodiment of the base portion 52*b*, the first portion 54 may comprise a movable connector portion 78 (see FIGS. 3A-3B) attached to a portion of a lower surface 46*b* (see FIG. 3*b*) of the adjustable setting blade 42*b* and substantially coextensive in length with the adjustable setting blade 42*b*. As shown in FIGS. 3A-3B, the movable connector portion 78 preferably comprises an elongated pivotable hinge 79 connected between the base portion 52*b* and the adjustable setting blade 42*b* and capable of pivotable movement to move the alignment assembly portion 22*b* and the adjustable setting blade 42*b* upwardly and downwardly as desired when mounting the doctor blade alignment device 10, such as in the form of the mountable doctor blade alignment device 10*b*, to the toner hopper 20 (see FIG. 3E). As shown in FIGS. 3A-3B, the hinged portion 78 has a first end 80*a*, a second end 80*b*, an elongated rod element 87 (see FIG. 3A), and hinge elements 88 (see FIG. 3B).

As shown in FIGS. 3A-3B, in this embodiment of the base portion 52*b*, the second portion 70 may comprise an elongated extending portion 66*b* having a first end 68*a*, a second end 68*b*, and an outer side 86*a*. In this embodiment, the outer side 86*a* is smooth and flat and does not have an elongated slot opening 74 (see FIG. 2A) for hand-held use.

As shown in FIGS. 3A-3B, in this embodiment of the base portion 52*b*, the base portion 52*b* may further comprise two or more attachment elements 82, such as in the form of screws, bolts, or another suitable attachment element, inserted into a bottom portion of the base portion 52*b*. Each attachment element 82 may be secured to the base portion 52*b* with an attachment element securing portion 84, such as a nut, washer, collar, or other suitable attachment element securing portion. The attachment elements 82 may be used to secure the movable connector portion 78 to the base portion 52*b* and/or may be used to connect the base portion 52*b* to the toner hopper 20 (see FIG. 3C), to the printer cartridge 11 (see FIG. 1), to a fixture (not shown) for holding the printer cartridge 11, or to another suitable structure during the alignment of the doctor blade 12 (see FIG. 1) with the doctor blade alignment device 10, such as in the form of the mountable doctor blade alignment device 10*b*.

Figure 3C:
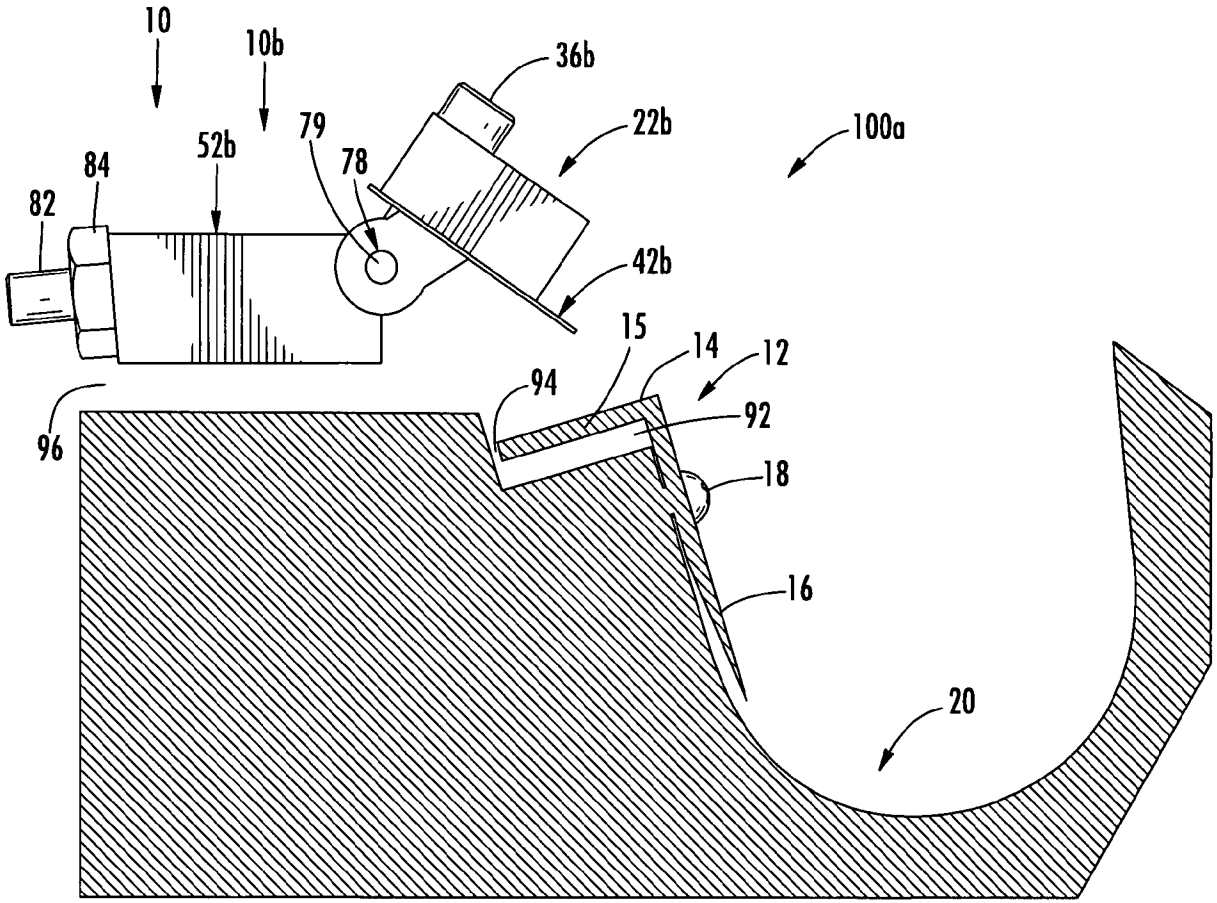
FIG. 3C is a side perspective view of the doctor blade alignment device of FIG. 3A in a first pre-alignment position with respect to a doctor blade in a toner hopper.

FIG. 3C is a side perspective view of the doctor blade alignment device 10, such as in the form of a mountable doctor blade alignment device 10*b*, of FIG. 3A in a first pre-alignment position 100*a* with respect to a doctor blade 12 in a toner hopper 20. During the alignment method, as shown in FIG. 3C, the doctor blade alignment device 10, such as in the form of a mountable doctor blade alignment device 10*b*, is positioned in area 96 over the toner hopper 20, so that the alignment assembly portion 22*b* and adjustable setting blade 42*b* are positioned over the support portion 14 of the doctor blade 12. As shown in FIG. 3C, the support portion 14 of the doctor blade 12 is attached to the toner hopper 20 with the fastener member 18, and the blade portion 16 is suspended below the support portion 14. As further shown in FIG. 3C, a contact portion 15 of the support portion 14 is positioned in the toner hopper 20 and forms a first gap 92 and a second gap 94 between the support portion and the toner hopper 20.

Figure 3D:
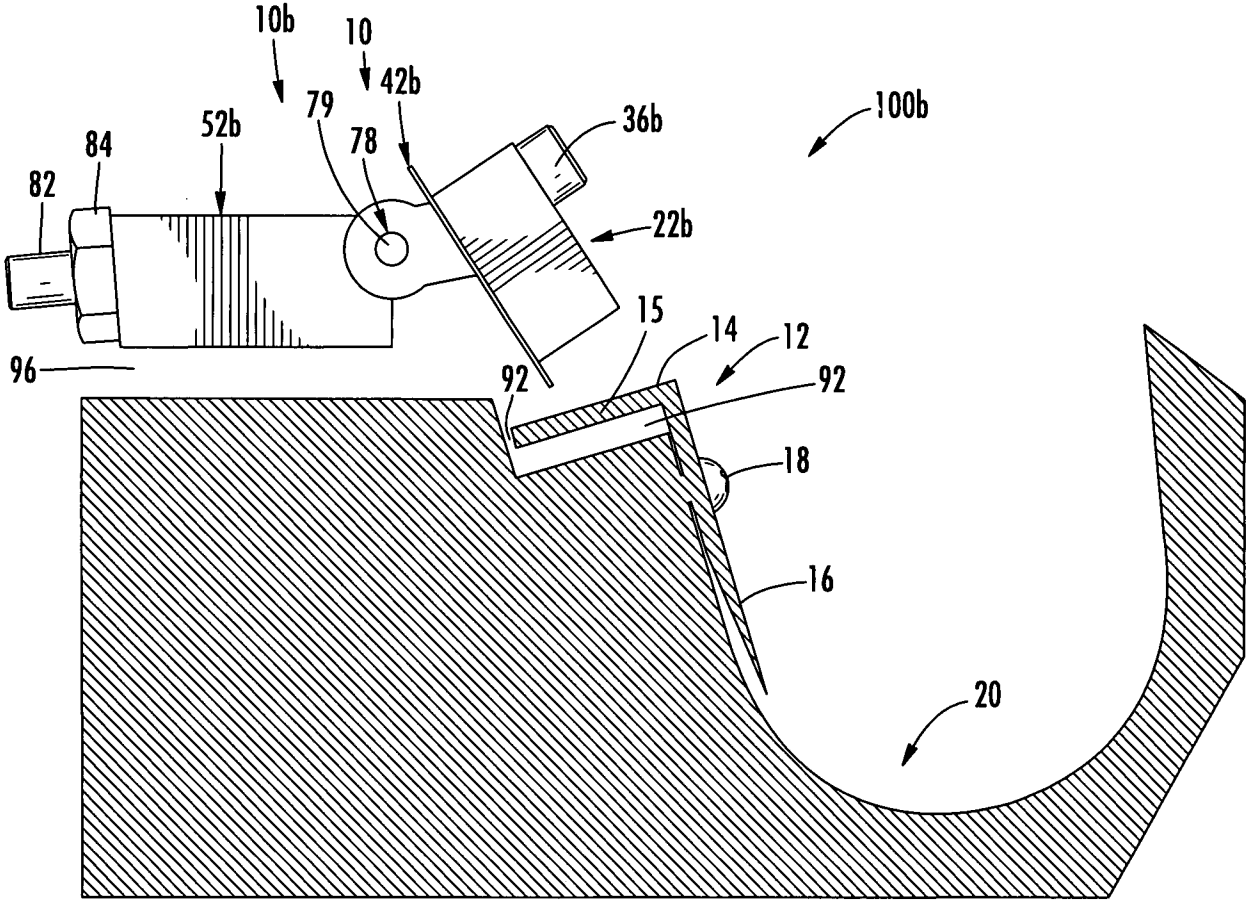
FIG. 3D is a side perspective view of the doctor blade alignment device of FIG. 3C in a second pre-alignment position with respect to a doctor blade in a toner hopper.

FIG. 3D is a side perspective view of the doctor blade alignment device 10, such as in the form of a mountable doctor blade alignment device 10*b*, of FIG. 3C in a second pre-alignment position 100*b* with respect to the doctor blade 12 in the toner hopper 20. During the alignment method, as shown in FIG. 3E, alignment assembly portion 22*b* and adjustable setting blade 42*b* are moved downwardly with the movable connector portion 78, to be in the second pre-alignment position 100*b*.

Figure 3E:
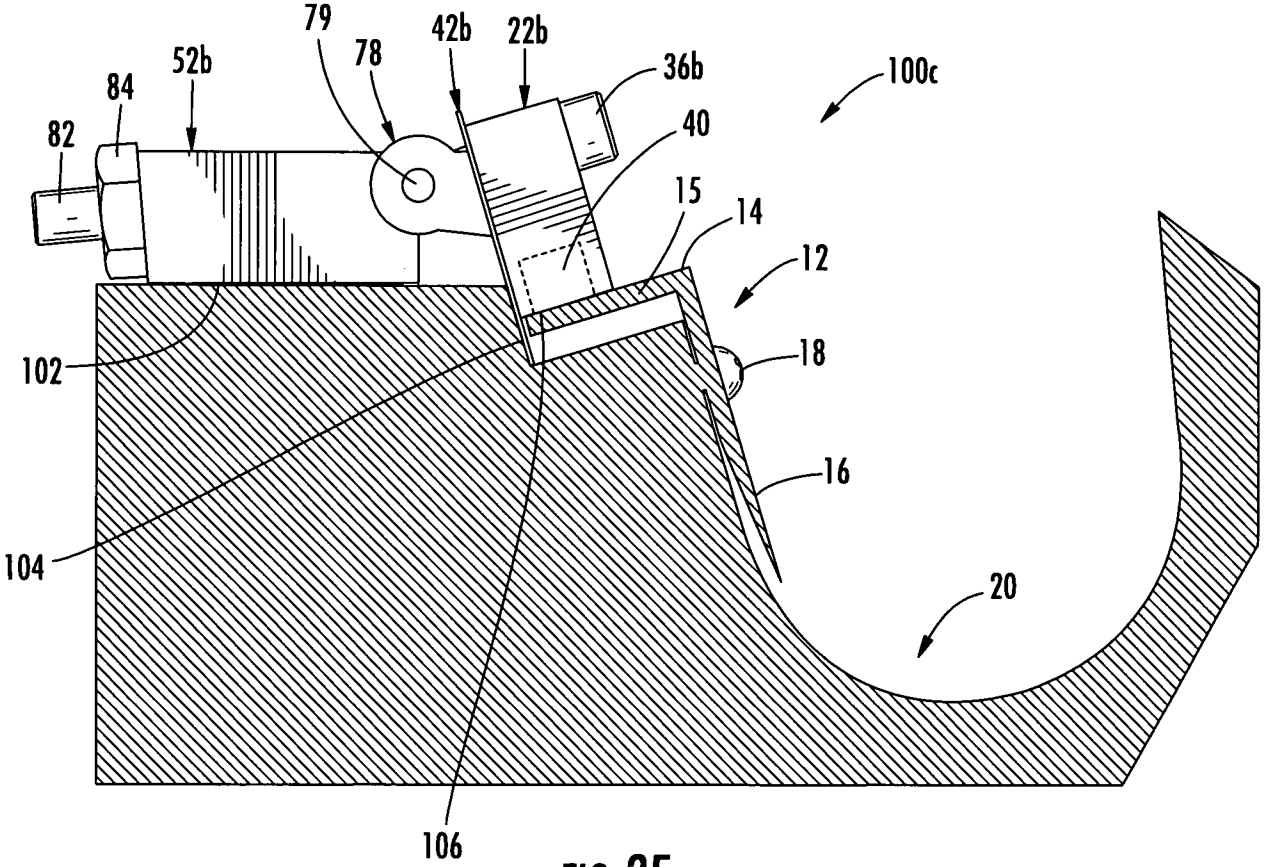
FIG. 3E is a side perspective view of the doctor blade alignment device of FIG. 3D in an alignment position with respect to a doctor blade in a toner hopper.

FIG. 3E is a side perspective view of the doctor blade alignment device 10, such as in the form of a mountable doctor blade alignment device 10*b*, of FIG. 3D in an alignment position 100*c* with respect to the doctor blade 12 in the toner hopper 20. As shown in FIG. 3E, the doctor blade alignment device 10, such as in the form of a mountable doctor blade alignment device 10*b*, is positioned on the toner hopper 20 in the alignment position 100*c* for aligning a doctor blade 12 for calibration or setting of the doctor blade alignment setting and/or for aligning the doctor blade 12 for alignment in a printer cartridge 11 (see FIG. 1) such as a remanufactured printer cartridge 11*a* (see FIG. 1). As further shown in FIG. 3E, the base portion 52*b* is mounted on the toner hopper 20 and contacts the toner hopper 20 at contact area 102, the adjustable setting blade 42*b* is inserted into the second gap 94 (see FIG. 3C) and contacts the toner hopper 20 at contact area 104, and the magnets 40 of the alignment assembly portion 22*b* are in contact with the contact portion 15 of the support portion 14 of the doctor blade 12 at contact area 106. In addition, the setting pin elements 38 (see FIG. 3B) not viewable in FIG. 3E are in contact with the support portion 14 of the doctor blade 12. The doctor blade 12 may be moved up or down to increase or decrease the thickness of the first gap 92. The thickness of the first gap 92 may vary depending on the model of the printer cartridge and the thickness of the first gap 92 may be in a typical range of 0.5 mm to 1.5 mm (millimeters), and preferably 1 mm. In addition, when the doctor blade 12 is moved up or down, this, in turn, may move the blade portion 16 up or down to obtain a desired contact position of the blade portion 16 to contact a developer roller (not shown) and to optimize contact with toner on the developer roller. In addition, during alignment, the blade adjustment elements 36*b* (see FIG. 3E) may be loosened or tightened to adjust the adjustable setting blade 42*b* and to set a setting of an original equipment manufacturer (OEM) known doctor blade prior to use or to align a doctor blade 12 in a printer cartridge 11 (see FIG. 1), such as remanufactured printer cartridge 11*a*.

Figure 7:
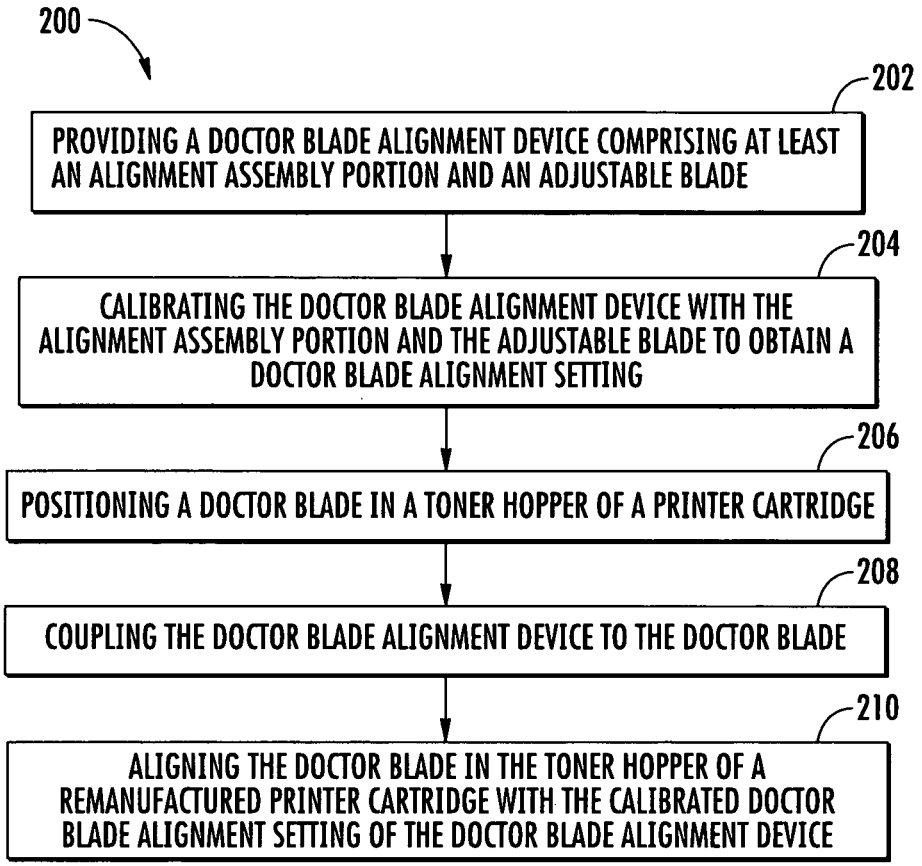

There is provided in another embodiment a method 200 for aligning a doctor blade 10 (see FIG. 1) in a toner hopper 20 (see FIG. 1) of a printer cartridge 11 (see FIG. 1), such as a remanufactured printer cartridge. FIG. 7 is an illustration of a flow diagram of an embodiments of the method 200 of the disclosure. As shown in FIG. 7, the method 200 comprises step 202 of providing a doctor blade alignment device 10 (see FIG. 1) comprising at least an alignment assembly portion 22*a* (see FIG. 2A) or alignment assembly portion 22*b* (see FIG. 3A), and comprising an adjustable setting blade 42*a* (see FIG. 2A) or adjustable setting blade 42*b* (see FIG. 3A).

As further shown in FIG. 7, the method 200 further comprises step 204 of calibrating the doctor blade alignment device 10 with the alignment assembly portion 22*a*, 22*b* and the adjustable setting blade 42*a*, 42*b* to obtain a doctor blade alignment setting. The alignment assembly portion 22*a*, 22*b* comprises at least two blade adjustment elements 36*a*, 36*b* (see FIGS. 2A, 3A). The calibrating step 204 further comprises loosening the at least two blade adjustment elements 36*a* or 36*b*, adjusting the adjustable setting blade 42*a* or 42*b* to a desired doctor blade alignment setting, and tightening the at least two blade adjustment elements 36*a* or 26*b* to set the desired doctor blade alignment setting.

As further shown in FIG. 7, the method 200 further comprises step 206 of positioning a doctor blade 12 (see FIGS. 1, 3E) in a toner hopper 20 (see FIGS. 1, 3E) of a printer cartridge 11 (see FIG. 1). As further shown in FIG. 7, the method 200 further comprises step 208 of coupling the doctor blade alignment device 10 to the doctor blade 12 (see FIGS. 1, 3E). The alignment assembly portion 22*a* or 22*b* comprises at least two magnet elements 40 (see FIG. 2A, 3B). The coupling step 208 further comprises loosely attaching the doctor blade 12 (see FIGS. 1, 3E) to the toner hopper 20 (see FIGS. 1, 3E) and contacting and coupling a support portion 14 (see FIGS. 1, 3E) of the doctor blade 12 with the at least two magnet elements 40 to retain the doctor blade 12 in place.

As further shown in FIG. 7, the method 200 further comprises step 210 of aligning the doctor blade 10 in the toner hopper 20 of the printer cartridge 11 with the doctor blade alignment setting of the doctor blade alignment device 10. The aligning step 210 further comprises aligning the doctor blade 12 (see FIGS. 1, 3E) by contacting and aligning the support portion 14 of the doctor blade 12 with at least two setting pin elements 38 (see FIG. 1) spaced apart along the alignment assembly portion 22*a* or 22*b*, and tightly attaching the doctor blade 12 to the toner hopper 20 of the printer cartridge 11 (see FIG. 1). The aligning step 210 further comprises aligning the doctor blade 12 in the toner hopper 20 of a remanufactured printer cartridge 11*a* (see FIG. 1) with the doctor blade alignment setting of the doctor blade alignment device 10.

The doctor blade alignment device 10 further comprises a base portion 52*a* (see FIG. 2A) or elongated base portion 52*b* (see FIG. 2B), attached to the adjustable setting blade 42*a*, 42*b*. In one embodiment, the base portion 52*a* has one or more positioning portions 62, 75, 76 (see FIGS. 2A, 4) configured to secure the doctor blade alignment device 10*a* to the toner hopper 20 during alignment of the doctor blade 12 in the toner hopper 20. In one embodiment, the base portion 52*a* comprises an elongated slot opening 74 (see FIG. 2A) for hand-held use. In another embodiment, the base portion 52*b* comprises a movable connector portion 78 between the base portion 52*b* and the adjustable setting blade 42*b*.

There is provided in another embodiment a doctor blade alignment device 10 (see FIG. 1) for aligning a doctor blade 12 (see FIG. 1) in a toner hopper 20 (see FIG. 1) of a remanufactured printer cartridge 11 (see FIG. 1). The doctor blade alignment device 10 comprises an alignment assembly portion 22*a* (see FIG. 2A), 22*b* (see FIG. 3A) comprising a doctor blade contact portion 26*a* (see FIGS. 2A, 3A) with at least two magnet elements 40 (see FIGS. 2A, 3B), at least two setting pin elements 38 (see FIGS. 2A, 3B), and at least two blade adjustment elements 36*a* (see FIG. 2A) or 36*b* (see FIG. 3A). The doctor blade alignment device 10 further comprises an adjustable setting blade 42*a* (see FIG. 2A) or 42*b* (see FIG. 3A) attached to the alignment assembly portion 22*a* or 22*b*, respectively, and substantially coextensive in length with the alignment assembly portion 22*a* or 22*b*, respectively. The doctor blade alignment device 10 further comprises a base portion 52*a* (see FIG. 2A) or 52*b* (see FIG. 3A). In one embodiment, the base portion 52*a* has a having an elongated hinged portion attached to the adjustable setting blade, and the elongated hinged portion is substantially coextensive in length with the adjustable setting blade. The alignment assembly portion and the adjustable setting blade set the doctor blade alignment device to obtain a doctor blade alignment setting for aligning a doctor blade in a toner hopper of a remanufactured printer cartridge. In one embodiment, the base portion 52*a* comprises an elongated slot opening 74 (see FIG. 2A) for hand-held use. In another embodiment, the base portion 52*b* comprises a movable connector portion 78 between the base portion 52*b* and the adjustable setting blade 42*b*.

The alignment assembly portion 22*a* (see FIG. 2A) or 22*b* (see FIG. 3A) further comprises slot through openings 30 (see FIGS. 2A, 3A). The adjustable setting blade 42*a* (see FIG. 2A) or 42*b* (see FIG. 3A) further comprises slot through openings 50 (see FIG. 2A). The base portion 52*a* comprises two insert openings 60 (see FIG. 2A). As shown in FIG. 2A, the slot through openings 30, the slot through openings 50, and the insert openings 60 are preferably in alignment and are configured to receive the two blade adjustment elements 36*a*, respectively. The at least two setting pin elements maintain a repeatable tolerance for the doctor blade alignment setting.

It can now be realized that the doctor blade alignment device 10 (see FIG. 1), such as in the form of the hand-held doctor blade alignment device 10*a* (see FIG. 2*a*), and the mountable doctor blade alignment device 10*b* (see FIG. 3A), and the related alignment method 200 (see FIG. 7) disclosed herein provide numerous advantages over known devices and methods, including but not limited to the following: provides a device and method that effectively aligns and positions a doctor blade with respect to a toner hopper and proximate to a developer roller or mag roller during assembly, manufacture, and remanufacture, which may be beneficial in allowing the doctor blade to regulate the toner amount on the developer roller or mag roller, and which may result in maximizing print quality during printing; provides a device and method that uses an alignment assembly portion with magnet elements at both ends to draw the doctor blade firmly against the setting pin elements at both ends, which may eliminate or minimize the need for an assembler or user to manually hold the doctor blade in order to tighten the fastener members to secure the doctor blade to the toner hopper; provides a device and method that may eliminate assembler or user mishandling, minimize rejected parts, and decrease assembly, manufacture, or remanufacture time; provides a device and method that does not require the use of permanently attached spacers, inserts, shims, or other spacing elements which may increase the overall cost and complexity and decrease the overall efficiency of the assembly, manufacturing, or remanufacturing processes; provides a method and device that aligns and positions a doctor blade within a toner hopper or a portion of a remanufactured toner printer cartridge to maximize printing quality of the remanufactured toner printer cartridge when it is in use with a laser printer device (not shown); provides a device and method that aligns and positions the doctor blade during replacement and remanufacture accurately and efficiently to an acceptable alignment or position point to maximize print quality during printing; provides a device and method having setting pin elements that allow and maintain repeatable tolerances of the doctor blade at both ends of the doctor blade; provides a device and method having blade adjustment elements at both ends of the device and that are designed to set or calibrate an OEM (original equipment manufacturing) setting or calibration of an OEM doctor blade prior to use as well as designed to set a doctor blade alignment setting for a replacement doctor blade, or a remanufactured doctor blade; provides a device and method that may only require a one time setting to set a doctor blade alignment setting, thus increasing efficiency and decreasing cost; and provides a method and device that provides magnet elements located near the positioning pins to facilitate holding the doctor blade in place and to attract the metallic doctor blade and keep it uniformly aligned during the doctor blade alignment and installation, thus allowing an assembler or user to freely align and mount and attach hands free the doctor blade with tightening the fastener members or screws.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A doctor blade alignment device for aligning a doctor blade in a toner hopper of a printer cartridge, the device comprising:

an alignment assembly portion comprising a doctor blade contact portion with at least two magnet elements and at least two blade adjustment elements;

an adjustable setting blade attached to the alignment assembly portion and substantially coextensive in length with the alignment assembly portion; and, a base portion attached to the adjustable setting blade and substantially coextensive in length with the adjustable setting blade, the base portion comprising a hinged portion attached to the adjustable setting blade and substantially coextensive in length with the adjustable setting blade, wherein the alignment assembly portion and the adjustable setting blade calibrate the doctor blade alignment device to obtain a doctor blade alignment setting for aligning a doctor blade in a toner hopper of a printer cartridge.

2. The device of claim 1 wherein the base portion comprises a holding portion and the doctor blade alignment device comprises a hand-held doctor blade alignment device.

3. The device of claim 1 wherein the alignment assembly portion further comprises at least two setting pin elements spaced apart along the doctor blade contact portion and configured to contact a support portion of the doctor blade during alignment of the doctor blade in the toner hopper.

4. The device of claim 1 wherein the at least two magnet elements are spaced apart along the doctor blade contact portion and are configured to contact a support portion of the doctor blade during alignment of the doctor blade in the toner hopper.

5. The device of claim 1 wherein the alignment assembly portion further comprises at least two alignment assembly portion through openings formed in the doctor blade contact portion, each alignment assembly portion through opening configured to receive each blade adjustment element.

6. The device of claim 1 wherein the adjustable setting blade comprises at least two adjustable setting blade through openings, each configured to receive each blade adjustment element.

7. The device of claim 1 wherein the base portion comprises at least two insert openings, and further comprises one or more positioning portions configured to secure the doctor blade alignment device to the toner hopper during alignment of the doctor blade in the toner hopper.

8. The device of claim 1 wherein the printer cartridge is a remanufactured printer cartridge.

9. A doctor blade alignment device for aligning a doctor blade in a toner hopper of a remanufactured printer cartridge, the device comprising:

an alignment assembly portion comprising a doctor blade contact portion with at least two magnet elements, at least two setting pin elements, and at least two blade adjustment elements;

an adjustable setting blade attached to the alignment assembly portion and substantially coextensive in length with the alignment assembly portion; and, a base portion attached to the adjustable setting blade and substantially coextensive in length with the adjustable setting blade, the base portion comprising a hinged portion attached to the adjustable setting blade and substantially coextensive in length with the adjustable setting blade, wherein the alignment assembly portion and the adjustable setting blade set the doctor blade alignment device to obtain a doctor blade alignment setting for aligning a doctor blade in a toner hopper of a remanufactured printer cartridge.

10. The device of claim 9 wherein the base portion comprises a holding portion, and the doctor blade alignment device comprises a hand-held doctor blade alignment device.

11. The device of claim 9 wherein the at least two setting pin elements maintain a repeatable tolerance for the doctor blade alignment setting.

12. A method for aligning a doctor blade in a toner hopper of a printer cartridge, the method comprising the steps of:

providing a doctor blade alignment device comprising at least an alignment assembly portion, an adjustable setting blade, and a base portion attached to the adjustable setting blade, the base portion having one or more positioning portions configured to secure the doctor blade alignment device to the toner hopper during alignment of the doctor blade in the toner hopper;

calibrating the doctor blade alignment device with the alignment assembly portion and the adjustable setting blade to obtain a doctor blade alignment setting;

positioning a doctor blade in a toner hopper of a printer cartridge;

coupling the doctor blade alignment device to the doctor blade; and, aligning the doctor blade in the toner hopper of the printer cartridge with the doctor blade alignment setting of the doctor blade alignment device.

13. The method of claim 12 wherein the base portion comprises a holding portion and the doctor blade alignment device comprises a hand-held doctor blade alignment device.

14. The method of claim 12 wherein the alignment assembly portion comprises at least two blade adjustment elements, and wherein the calibrating step further comprises loosening the at least two blade adjustment elements, adjusting the adjustable setting blade to a desired doctor blade alignment setting, and tightening the at least two blade adjustment elements to set the desired doctor blade alignment setting.

15. The method of claim 12 wherein the alignment assembly portion comprises at least two magnet elements, and wherein the coupling step further comprises loosely attaching the doctor blade to the toner hopper and contacting and coupling a support portion of the doctor blade with the at least two magnet elements to retain the doctor blade in place.

16. The method of claim 15 wherein the aligning step further comprises aligning the doctor blade by contacting and aligning the support portion of the doctor blade with at least two setting pin elements spaced apart along the alignment assembly portion, and tightly attaching the doctor blade to the toner hopper of the printer cartridge.

17. The method of claim 12 wherein the aligning step further comprises aligning the doctor blade in the toner hopper of a remanufactured printer cartridge with the doctor blade alignment setting of the doctor blade alignment device.

* * * * *